US006276443B1

(12) United States Patent
Martin, Sr.

(10) Patent No.: US 6,276,443 B1
(45) Date of Patent: Aug. 21, 2001

(54) AIR CONDITIONING COIL

(76) Inventor: Lendell Martin, Sr., P.O. Box 40696, Houston, TX (US) 77240-0698

( * ) Notice: Subject to any disclaimer, the term of this patent is extended or adjusted under 35 U.S.C. 154(b) by 0 days.

(21) Appl. No.: 09/450,257

(22) Filed: Nov. 29, 1999

(51) Int. Cl.[7] ..... F28F 9/26; F28F 13/00

(52) U.S. Cl. ..... 165/126; 165/124; 165/145; 165/146

(58) Field of Search ..... 165/122, 144, 165/145, 151, 124, 126, 146; 62/515

(56) References Cited

U.S. PATENT DOCUMENTS

| | | | | |
|---|---|---|---|---|
| 1,846,608 | | 2/1932 | Phelps . | |
| 2,584,442 | | 2/1952 | Frie . | |
| 3,596,475 | | 8/1971 | Berger . | |
| 3,708,011 | * | 1/1973 | Serratto | 165/122 X |
| 3,716,097 | | 2/1973 | Kelp et al. . | |
| 4,000,779 | | 1/1977 | Irwin . | |
| 4,076,072 | | 2/1978 | Bentz . | |
| 4,474,232 | | 10/1984 | Wright et al. . | |
| 4,542,786 | | 9/1985 | Anders . | |
| 4,671,076 | | 6/1987 | Duren . | |
| 5,199,276 | | 4/1993 | Sullivan . | |
| 5,207,074 | | 5/1993 | Cox et al. | 62/515 X |
| 5,284,027 | | 2/1994 | Martin, Sr. | 165/126 X |
| 5,664,431 | | 9/1997 | Martin, Sr. . | |
| 5,967,228 | | 10/1999 | Bergman et al. . | |

FOREIGN PATENT DOCUMENTS

| | | | | |
|---|---|---|---|---|
| 2 048 450 | | 12/1980 | (GB) . | |
| 1-150722 | * | 6/1989 | (JP) | 165/146 |

OTHER PUBLICATIONS

"A Coil of Quality Allstyle," Allstyle Coil Co., Inc., 1996.

* cited by examiner

*Primary Examiner*—Leonard Leo
(74) *Attorney, Agent, or Firm*—Guy McClung

(57) ABSTRACT

An air conditioning coil system having a first and a second outside tubing slab, a first and a second inside tubing slab, the inside tubing slabs positioned between the outside tubing slabs, a top of the first outside tubing slab contacting a top of the first inside tubing slab, a top of the second outside tubing slab contacting a top of the second inside tubing slab, and a bottom of the first inside tubing slab contacting a bottom of the second inside tubing slab, each tubing slab having a plurality of spaced-apart heat exchange fins, each outside tubing slab having a plurality of spaced-apart tubing rows extending through he plurality of heat exchange fins of the corresponding outside tubing slab, and each inside tubing slab having at least one tubing row extending through the plurality of heat exchange fins of the corresponding inside tubing slab. The air conditioning coil system wherein the at least one tubing row of each inside tubing slab is one row less than the number of tubing rows of the plurality of spaced-apart tubing rows in one of the outside tubing slabs.

14 Claims, 3 Drawing Sheets

AIR CONDITIONING COIL

BACKGROUND OF THE INVENTION

1. Field of The Invention

This invention is directed to air conditioning coils and methods of their use.

2. Description of Related Art

Many prior art air conditioning systems require relatively large evaporator coils to achieve higher energy efficiencies. In certain systems it is desired to expose more face area of a coil to an air stream utilizing lower "face velocity," but without enlarging coil height. The "face velocity" of an air conditioning coil is often defined as the total volummetric air flow passing through the coil divided by the total effective upstream side surface area of the coil. For example, the face velocity of a coil having a 2.0 square foot face area across which a 1200 cubic feet/minute air flow occurs would be 600 feet/minute. In various prior art systems refrigerant coils (such as conventional A-coils) used in the indoor sections of air conditioning equipment have a coil face velocity maintained within the 100–500 feet/minute velocity range. A coil face velocity above about 500 feet/minute may result in an unacceptable degree of condensate "blow through" or "blow off" and may raise the air pressure drop across the coil to an undesirable level.

Various prior art coils have two refrigerant coil slabs of a multi-row, multi-circuit construction for purposes of heat exchange efficiency. This multi-row/multi-circuit configuration may result in an air pressure drop across the coil that, as a practical matter, precludes the use in the coil of "enhanced" fins (i.e., fins of, for example, a lanced or louvered construction designed to increase the air-to-fin heat exchange efficiency). Typically fin spacing in prior art coils is between 10 to 22 fins/inch.

FIGS. 1A and 1B show a prior art coil C as disclosed in U.S. Pat. No. 5,207,074 that has a single row/single circuit design with fin spacing in the range of about 16 fins/inch to about 22 fins/inch. Face velocity for such a coil is from about 100 feet/minute to about 200 feet/minute. By "single row/single circuit" is meant that there is a single row R of tubing, typically copper tubing, on each side of each coil and the tubing on each side is a single elongated piece with a plurality of U-turns extending through a plurality of fins F.

FIG. 2 shows another prior art single row/single circuit coil L as disclosed in U.S. Pat. 5,664,431 with single tubing rows T passing through a plurality of fins P. Fin spacing for such a coil may be 16–22 fins/inch and a typical face velocity of 300–450 feet/minute.

FIG. 3 shows prior art coils S, as disclosed in U.S. Pat. No. 5,284,027, each dual row/dual circuit tubing B on each side extending through a plurality of fins N, e.g. with fin spacing of 10–16 fins/inch and a typical face velocity of 170–250 feet/minute.

Another important consideration in coil design for heat pumps is the desire to maintain a certain volummetric relationship between an indoor heat exchanger and an outdoor heat exchanger. Using fewer rows of tubing reduces volummetric capacity and often a receiver is added to maintain the desired relationship (e.g. 0.8:1 to 1.2:1) between an indoor coil and an outdoor coil.

In many prior art coils each side or "slab" of the coil has the same number of rows of tubing and the same fin spacing.

There has long been a need for an effective and efficient air conditioning coil. There has long been a need for such a coil with increased capacity without significantly enlarging coil height. There has long been a need for such a coil with more exposed face area.

SUMMARY OF THE PRESENT INVENTION

The present invention discloses, in certain aspects, discloses an air conditioning coil with four slabs in a side-by-side double "A" configuration. Each of two outer slabs has two rows of tubing, e.g. (in a single circuit or in two circuits) with fin spacing between 10 and 16 fins/inch. In one aspect the fin spacing is 14 fins/inch. Each of two inner slabs has one row of tubing in a single circuit, e.g. with a fin spacing between 16 and 22 fins/inch. In one aspect fin spacing is 20 fins/inch.

In certain aspects the pressure drop across the two row slabs is within 10% of the pressure drop across the one-row slabs and, in certain preferred embodiments, the pressure drop is within 5%. This similarity in pressure drop provides relatively even air distribution across the coil face.

In certain aspects each of the slabs has tube spacing of one inch on center ("tube spacing" is the distance from the center of one tube to the center of another) that is about the same as the width of the fins ("fin width" is the distance from a fin leading edge to a fin trailing edge).

In certain embodiments, using twice the number of tubes in the two-row coils increases the coils volummetric capacity by about 100% (e.g. 40 tubes in the two-row slabs as compared to 20 tubes in the one-row slab).

In another embodiment of a coil according to the present invention in which there are two outer slabs and two inner slabs in a double "A" configuration, the outer slabs are two-row or three-row (in a single circuit or in multiple circuits) and the inner slabs are one-row or two-rows (in a single circuit or in multiple circuits), with fin spacing as described above.

What follows are some of, but not all, the objects of this invention. Objects other than the specific objects stated below, additional objects and purposes will be readily apparent to one of skill in this art who has the benefit of this invention's teachings and disclosures. It is, therefore, an object of at least certain preferred embodiments of the present invention to provide new, useful, unique, efficient and nonobvious air conditioning coils;

Such coils with multiple slabs with slabs having different members of tubing rows;

Such coils with slabs having a plurality of fins and different slabs having different fin spacing;

Such coils with relatively increased volummetric capacity without relatively increased height;

Such coils with different slabs (different numbers of rows and/or fin spacing) but with similar air pressure drop across the slabs;

Such slabs with tube spacing similar to fin width per row; and

Methods of using such coils.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 4A:
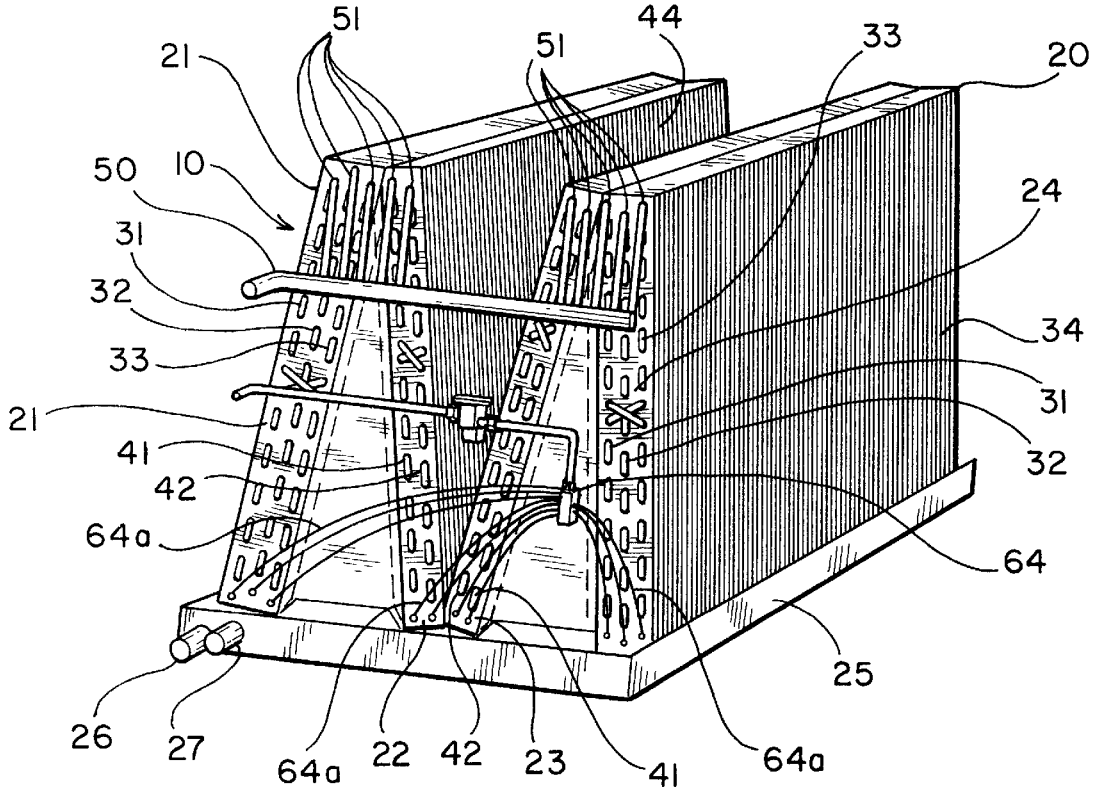
FIG. 4A is a perspective view of a coil system according to the present invention.

FIG. 4A shows a coil system 10 according to the present invention with a multi-slab coil 20 that includes four slabs 21, 22, 23, and 24. The coil 20 is shown ion a drain pan 25 which may be any suitable drain pan, including, but not limited to, a drain pan as shown in U.S. patent application Ser. No. 09/144,023 filed Aug. 3, 1998, now U.S. Pat. No. 5,987,909 entitled "Air Conditioner Drain Pan" which is incorporated fully herein for all purposes. Drain connections 26, 27 provide fluid exits from the pan.

Figure 1A:
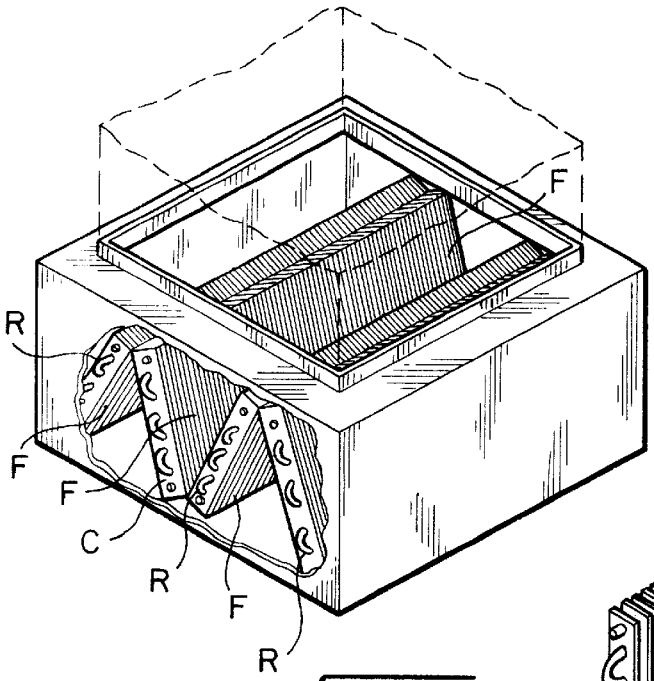
FIG. 1A (PRIOR ART)
FIG. 1A is a perspective view of a prior art air conditioning system.
Figure 1B:
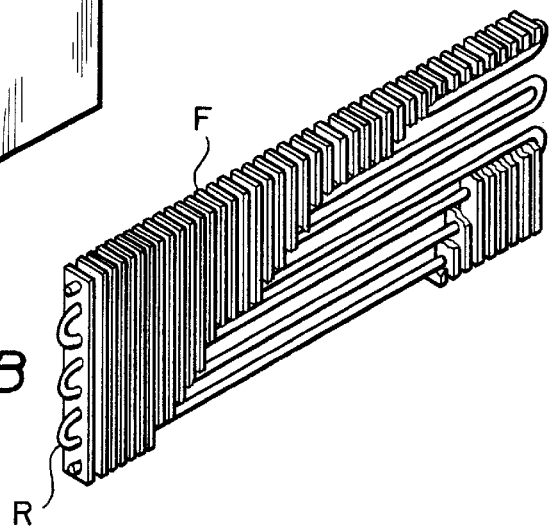
FIG. 1B (PRIOR ART)
FIG. 1B shows part of a coil of the system of FIG. 1A.
Figure 2:
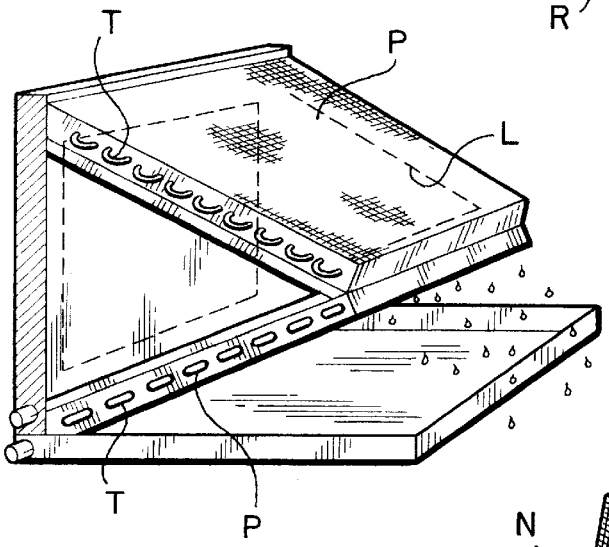
FIG. 2 (PRIOR ART)
FIG. 2 is a perspective view of a prior art coil.
Figure 3:
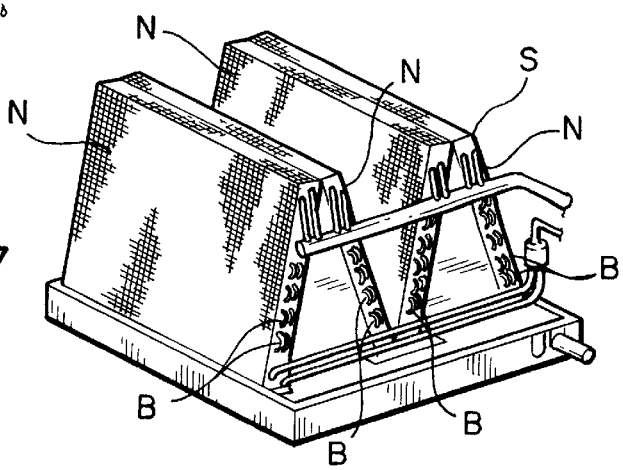
FIG. 3 (PRIOR ART)
FIG. 3 is a perspective view of a prior art coil.

Each outer slab 21, 24 has three rows 31, 32, 33 of tubing which extend through a plurality of fins 34 in each slab (e.g. as the tubing extends back and forth through the fins of the coil of FIG. 1B).

Each inner slab 22, 23 has two rows 41, 42 of tubing which extend through a plurality of fins 44 in each slab (e.g. as the tubing extends back and forth in the fins of the coil of FIG. 1A).

The slabs 21, 22 and the slabs 23, 24 are connected at the top and the coils 22, 23 contact each other at the bottom.

Refrigerant fluid is introduced into the rows of tubing through a manifold 61 and a series of interconnected tubes 64 providing communication between the manifold 61 and each tubing row. Fluid is metered by a metering device 62 which communicates with a distributor 64 through a line 63. The distributor 64 is in fluid communication with all tubes of the individual rows (31, 32, 33, 41, 42) via connecting lines 64*a*. Alternatively, the distributor 64 is in fluid communication with all of a slabs circuits or circuit (in a single-circuit slab) (if all tubes are in fluid communication). Vapor exits the coil through tubes 51 which are in fluid communication with a suction manifold 50.

In one particular embodiment, for the slabs 21, 24, the fin spacing is 11 fins per inch; the fin width per row is 0.866 inches; and the tube spacing is 1.0 inch; and for the slabs 22, 23, the fin spacing is 12 fins per inch; the fin width per row is 0.866 inches; and the tube spacing is 1.0 inch. Such a coil is about twenty inches in height. The air pressure drop across the slabs 21, 24 is about 0.11 inches and the air pressure drop across the slabs 22, 23 is about 0.10 inches.

It is within the scope of this invention to provide only one tubing row in the slabs 22, 23, e.g. with a tube spacing of about one inch. It is within the scope of this invention to provide a multiple number of rows of tubing in the slabs 21, 24 and one, two or three less rows of tubing in the slabs 22, 23.

Figure 4B:
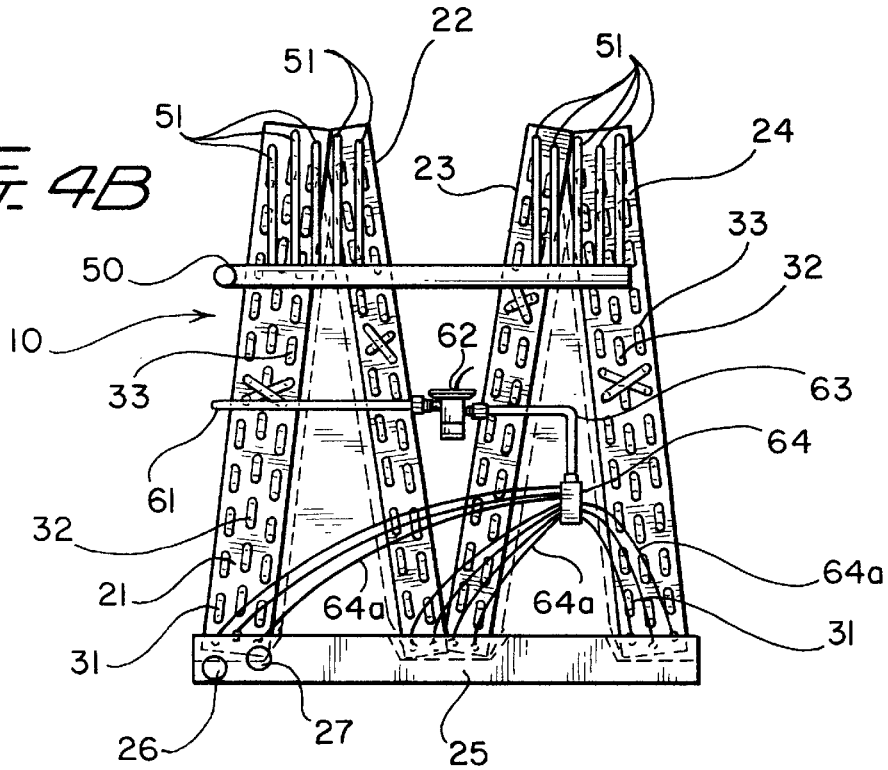
FIG. 4B is a front view of the system of FIG. 4A.
Figure 4C:
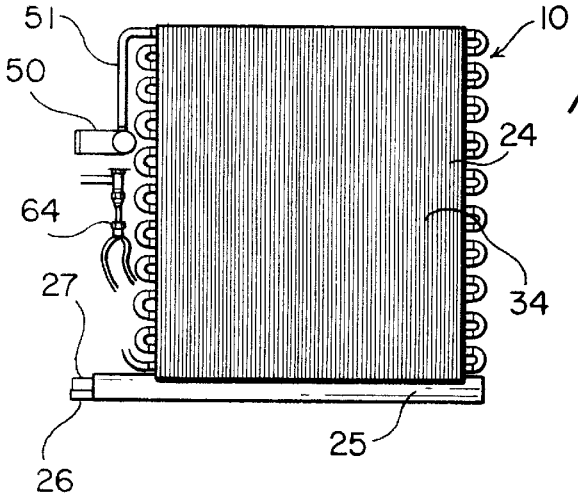
FIG. 4C is a side view of the system of FIG. 4A.
Figure 4D:
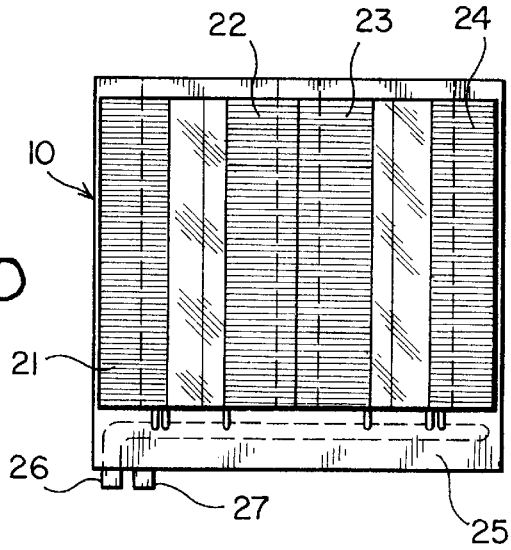
FIG. 4D is a top view.
Figure 4E:
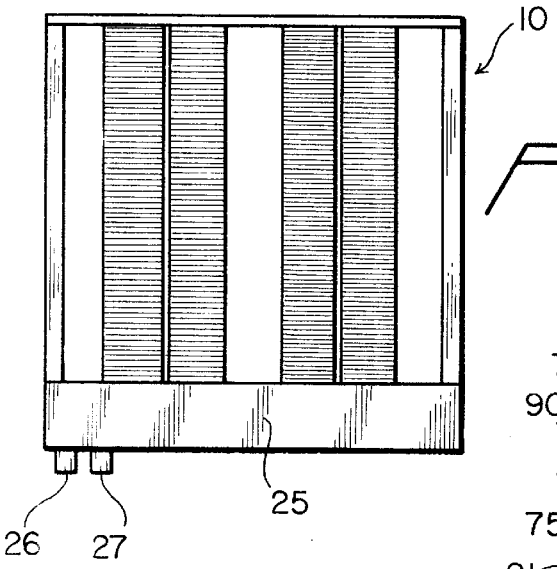
FIG. 4E is a bottom view of the system of FIG. 4A.
Figure 5:
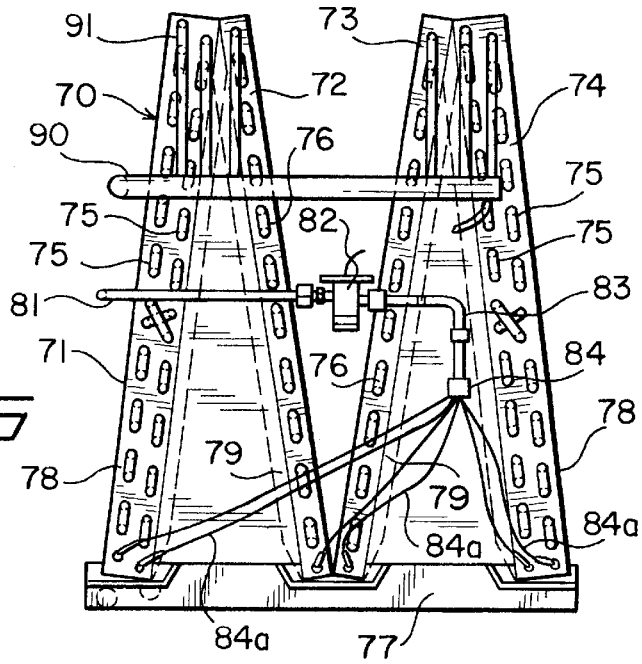
FIG. 5 is a front view of a coil system according to the present invention.

FIG. 5 shows a coil system 70 with four slabs 71, 72, 73, 74. The slab 71, 74 have two tubing rows 75 and the slabs 72, 73 have one tubing row 76. A manifold 90 with tubes 91 functions like the manifold 50 and tubes 51. Items 81, 82, 83, 84 are like items 61, 62, 63, and 64, respectively, of FIG. 4B. Lines 84*a* are like lines 64*a* (FIG. 4B). The coil system 70 rests on a drain pan 77 (like the pan 25. FIG. 4A). Side and top views of the coil system 70 are similar to those of the coil system 10 described above.

Slabs 71, 74 have a plurality of fins 78 with a fin spacing, in one particular embodiment, of 14 fins/inch. Slabs 72, 73 have a plurality of fins 79 with a fin spacing, in one particular embodiment, of 20 fins/inch; tube spacing for the slabs 72, 74 of one inch; and tube spacing for the slabs 72, 73 of one inch. Fin width per row, in one particular embodiment, for the slabs 71, 74 is 0.866 inches and for the slabs 72, 73 is 0.866 inches. The air pressure drop across the slabs 71, 74 is 0.13 inches and across the slabs 72, 73 is 0.125 inches. In one particular aspect such a coil system 70 is about 20 inches in height.

It is within the scope of this invention to provide a multi-slab system in which there is an equivalent or nearly-equivalent static pressure between dissimilar slabs to generate an equal or relatively equal air flow through the slabs. For any embodiment disclosed herein, only one outside slab and one inside slab may be used, forming a "V" configured coil (e.g. but not limited to the two left-most slabs in FIG. 4B or in FIG. 5, with fin spacing, etc. as described above for the particular slabs).

The present invention, therefore, in some, but in not necessarily all embodiments, provides an air conditioning coil system with a first and a second outside tubing slab, a first and a second inside tubing slab, the inside tubing slabs positioned between the outside tubing slabs, a top of the first outside tubing slab contacting a top of the first inside tubing slab, a top of the second outside tubing slab contacting a top of the second inside tubing slab, and a bottom of the first inside tubing slab contacting a bottom of the second inside tubing slab, each tubing slab having a plurality of spaced-apart heat exchange fins, each outside tubing slab having a plurality of spaced-apart tubing rows extending through the plurality of heat exchange fins of the corresponding outside tubing slab, and each inside tubing slab having at least one tubing row extending through the plurality of heat exchange fins of the corresponding inside tubing slab. Such a system may have one or some (in any possible combination) of the following: the at least one tubing row of each inside tubing slab is one row less than the number of tubing rows comprising the plurality of spaced-apart tubing rows in one of the outside tubing slabs; wherein there are three outside tubing rows and two inside tubing rows; wherein there are two outside tubing rows and one inside tubing rows; wherein fin spacing in the outside tubing slabs is between 10 and 16 fins/inch and fin spacing in the inside tubing slabs is between 16 and 22 fins/inch; wherein fin spacing in the outside tubing rows is 14 fins/inch and fin spacing in the inside tubing rows is 20 fins/inch; wherein air pressure drop across each of the slabs is substantially the same; wherein air pressure drop across the outside tubing slabs is within 10% of air pressure drop across the inside tubing slabs; wherein air pressure drop across the outside tubing slabs is within 5% of air pressure drop across the inside tubing slabs wherein air pressure drop across each of the slabs is substantially the same; a drain pan below the slabs; wherein air flow rate through all slabs is substantially equal; and/or an inlet manifold with a plurality of tubes in fluid communication with the tubing rows for flowing refrigerant fluid to the slabs, and an outlet manifold in fluid communication with the tubing rows via a plurality of outlet tubes for flowing fluid from the tubing rows.

The present invention, therefore, in some, but in not necessarily all embodiments, provides an air conditioning coil system with at least one outside tubing slab, at least one inside tubing slab, a top of the at least one outside tubing slab contacting a top of the at least one inside tubing slab, a bottom of the at least one outside tubing slab spaced-apart from a bottom of the at least one inside tubing slab, each tubing slab having a plurality of spaced-apart heat exchange fins, the at least one outside tubing slab having a plurality of spaced-apart tubing rows extending through the plurality of heat exchange fins of the at least one outside tubing slab; the at least one inside tubing slab having at least one tubing row extending through the plurality of heat exchange fins of the at least one inside tubing slab; wherein air flow rate through all slabs is substantially equal; and/or wherein air pressure drop across each of the slabs is substantially the same.

The present invention, therefore, in some, but in not necessarily all embodiments, provides a method for conditioning air, the method comprising flowing air to an air conditioning coil system, according to the present invention, and conditioning the air by flowing it through the air conditioning coil system; and such a method wherein air flow rate through all slabs is substantially equal and/or air pressure drop across each of the slabs is substantially the same.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. §102 and satisfies the conditions for patentability in §102. The invention claimed herein is not obvious in accordance with 35 U.S.C. §103 and satisfies the conditions for patentability in §103. This specification and the claims that follow are in accordance with all of the requirements of 35 U.S.C. §112. The invention claimed herein is not obvious in accordance with 35 U.S.C. §103 and satisfies the conditions for patentability in §103. This specification and the claims that follow are in accordance with all of the requirements of 35 U.S.C. §112. The inventor may rely on the Doctrine of Equivalents to determine and assess the scope of the invention and of the claims that follow as they may pertain to apparatus not materially departing from, but outside of, the literal scope of the invention as set forth in the following claims.

What is claimed is:

1. An air conditioning coil system comprising a first and a second outside tubing slab, a first and a second inside tubing slab, the inside tubing slabs positioned between the outside tubing slabs, a top of the first outside tubing slab contacting a top of the first inside tubing slab, a top of the second outside tubing slab contacting a top of the second inside tubing slab, and a bottom of the first inside tubing slab contacting a bottom of the second inside tubing slab, each tubing slab having a plurality of spaced-apart heat exchange fins, each outside tubing slab having a plurality of spaced-apart tubing rows extending through the plurality of heat exchange fins of the corresponding outside tubing slab, each inside tubing slab having at least one tubing row extending through the plurality of heat exchange fins of the corresponding inside tubing slab, and the at least one tubing row of each inside tubing slab is one row less than the number of tubing rows comprising the plurality of spaced-apart tubing rows in one of the outside tubing slabs.

2. The air conditioning system of claim 1 wherein there are three outside tubing rows and two inside tubing rows.

3. The air conditioning system of claim 2 wherein fin spacing in the outside tubing slabs is between 10 and 16 fins/inch and fin spacing in the inside tubing slabs is between 16 and 22 fins/inch.

4. The air conditioning system of claim 3 wherein fin spacing in the outside tubing rows is 14 fins/inch and fin spacing in the inside tubing rows is 20 fins/inch.

5. The air conditioning coil system of claim 2 wherein air pressure drop across each of the slabs is substantially the same.

6. The air conditioning coil system of claim 2 wherein air pressure drop across the outside tubing slabs is within 10% of air pressure drop across the inside tubing slabs.

7. The air conditioning coil system of claim 2 wherein air pressure drop across the outside tubing slabs is within 5% of air pressure drop across the inside tubing slabs.

8. The air conditioning system of claim 1 wherein there are two outside tubing rows and one inside tubing row.

9. The air conditioning coil system of claim 1 wherein air pressure drop across each of the slabs is substantially the same.

10. The air conditioning coil system of claim 1 wherein air pressure drop across the outside tubing slabs is within 10% of air pressure drop across the inside tubing slabs.

11. The air conditioning coil system of claim 1 wherein air pressure drop across the outside tubing slabs is within 5% of air pressure drop across the inside tubing slabs.

12. The air conditioning coil system of claim 1 further comprising a drain pan below the slabs.

13. The air conditioning coil system of claim 1 wherein air flow rate through all slabs is substantially equal.

14. The air conditioning coil system of claim 1 further comprising an inlet manifold with a plurality of tubes in fluid communication with the tubing rows for flowing refrigerant fluid to the slabs, and an outlet manifold in fluid communication with the tubing rows via a plurality of outlet tubes for flowing fluid from the tubing rows.

* * * * *